US007424251B2

(12) United States Patent
Watanabe et al.

(10) Patent No.: US 7,424,251 B2
(45) Date of Patent: Sep. 9, 2008

(54) FILM DRIVING APPARATUS AND IMAGE FORMING APPARATUS USING THE SAME

(75) Inventors: Takeshi Watanabe, Hitachinaka (JP); Akihiko Yamazaki, Hitachinaka (JP); Sho Sawahata, Hitachinaka (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 179 days.

(21) Appl. No.: 11/482,054

(22) Filed: Jul. 7, 2006

(65) Prior Publication Data

US 2007/0020014 A1 Jan. 25, 2007

(30) Foreign Application Priority Data

Jul. 8, 2005 (JP) ..... 2005-200067

(51) Int. Cl.
*G03G 15/00* (2006.01)

(52) U.S. Cl. ..... 399/165; 399/162

(58) Field of Classification Search ..... 399/165, 399/162, 301, 395, 394, 303, 313, 329; 198/804, 198/807

See application file for complete search history.

(56) References Cited

U.S. PATENT DOCUMENTS 5,397,043 A * 3/1995 Blanding ..... 226/21
5,471,289 A * 11/1995 Satoh et al. ..... 399/328
6,421,513 B1 * 7/2002 Casella et al. ..... 399/162
2003/0068176 A1 * 4/2003 Sanchez-Banos et al. ... 399/165
2003/0123903 A1 * 7/2003 Loebel et al. ..... 399/165
2006/0119029 A1 * 6/2006 Kitamura ..... 371/275

FOREIGN PATENT DOCUMENTS

JP 8-217302 A 8/1996
JP 2002-148882 A * 5/2002

* cited by examiner

*Primary Examiner*—Sophia S Chen
(74) *Attorney, Agent, or Firm*—Crowell & Moring LLP

(57) ABSTRACT

The invention provides a film driving apparatus in which no adverse effect is caused by a change in the circumferential length of a film even if there arises the change in circumferential length of the film due to environmental fluctuation. In the film driving apparatus, an endless film 1 supported by a driving roller 2, a film support roller 4 and a skew correction roller 3 is rotated in a predetermined direction by the rotation of a driving roller 2. The skew correction roller 3 has a structure in which one end thereof is movable with the other end as a fulcrum. The movement trajectory of the movable end portion of the skew correction roller 3 is an elliptic trajectory not causing any change in the circumferential length of the film 1.

6 Claims, 6 Drawing Sheets

FILM DRIVING APPARATUS AND IMAGE FORMING APPARATUS USING THE SAME

FIELD OF THE INVENTION

The present invention relates to a film driving apparatus for driving a film such as a photosensitive film, an intermediate transfer film, a transfer film or the like for use in an image producing portion, a transfer portion or the like of an image forming apparatus.

DESCRIPTION OF THE BACKGROUND ART

FIG. 4 shows a schematic view of a background-art film driving apparatus (for example, see JP-A-8-217302). Examples of films may include a photosensitive film, an intermediate transfer film, a transfer film, etc. Here, a photosensitive film will be used by way of example, and a driving apparatus for driving the photosensitive film will be described.

In FIG. 4, the reference numeral 1 represents a film (photosensitive film); 2, a driving roller; 3, a skew correction roller; 4, a film support roller; and 5, a developing-unit opposed roller. The film 1 is supported by the driving roller 2, the skew correction roller 3, the film support roller 4 and the developing-unit opposed rollers 5 so as to form a path. The film 1 is rotated in the illustrated arrow direction by the driving roller 2.

The configuration of a skew correction mechanism portion will be described. The opposite ends of the skew correction roller 3 are retained by arms 8 and 8 respectively. The arms 8 and 8 are linked with brackets 9*a* and 9*b* including bearings through their shafts, respectively. The brackets 9*a* and 9*b* are linked with a not-shown frame body so as to retain the skew correction roller 3.

The movable bracket 9*a* can be rotated around a rotation axis a by a cam 10, while the arms 8 and 8 can be rotated around axes d through the bearings included in the brackets 9*a* and 9*b* respectively. Therefore, only one end portion of the skew correction roller 3 is moved in a circular trajectory with the rotation axis a as the center so as to correct the skew of the film 1.

Further, there is a structure in which a spring 20 is set between each arm 8, 8 and each bracket 9*a*, 9*b* so that the arm 8 can be moved to expand and contract axially. Thus, the skew correction roller 3 also has a function of applying tension to the film 1.

A process for producing an image on the film 1 will be described. As shown in FIG. 5, the film 1 is charged by a charger 15 and irradiated with a laser beam from a light source 16 so that an exposure point where a latent image should be produced on the film 1 is provided in a film path portion wound on the film support roller 4. Thus, a latent image is produced.

Successively, toner is attached to the latent image by a developing unit 17. The produced image is transferred onto paper, a transfer film or the like at a transfer point. After the transfer, charges of the film 1 are removed by a discharger 18, and residual toner on the film 1 is removed by a cleaner 19 in order to prepare next charging.

Here, as for the characteristic of the film 1, the circumferential length of the film 1 changes due to a change in temperature or humidity. When there arises a change in the circumferential length of the film 1 during a printing operation, the arms 8 moves to expand and contract due to the operation of the springs 20 in the skew correction mechanism portion so that the position of the skew correction roller 3 is changed, as shown by the broken-like portion in FIG. 5. In this manner, the change of the circumferential length is absorbed.

In the aforementioned background-art film driving apparatus, however, the film path changes near the skew correction roller 3 so that there arises a fluctuation in the film path length between the exposure point and the transfer point.

When there arises a fluctuation in the film path length between the exposure point and the transfer point as described above, the distance between the exposure point and the transfer point on the film 1 changes so that the position of the image formed in the exposure point is shifted from an original printing target point. Thus, there arises a problem of printing misalignment.

The movement trajectory of the movable end portion of the skew correction roller will be described. A trajectory not causing any change in the circumferential length of the film near the skew correction roller 3 is an elliptic trajectory b with focuses in the centers of the adjacent film support roller 4 and the adjacent developing-unit opposed roller 5, as shown in FIG. 6. According to a film skew correction system in the background art, the movement trajectory of the movable end portion of the skew correction roller is a circular trajectory c. Thus, a misalignment arises with respect to the elliptic trajectory b not causing any change in the circumferential length of the film. As a result, there is a problem that printing misalignment arises due to a change in the circumferential length of the film near the skew correction roller 3.

SUMMARY OF THE INVENTION

In order to solve the foregoing problems in the background art, an object of the present invention is to provide a film driving apparatus in which no adverse effect is caused by a change in the circumferential length of a film even if there arises the change in the circumferential length of the film due to environmental fluctuation, and to provide an image forming apparatus using the same film driving apparatus.

In order to attain the forgoing object, a film driving apparatus according to a first configuration of the invention includes: a driving roller; a film support roller; and a skew correction roller; wherein: an endless film supported by the driving roller, the film support roller and the skew correction roller is rotated in a predetermined direction in accordance with rotation of the driving roller; and the skew correction roller has a structure in which one end thereof is movable with the other end as a fulcrum, and a movement trajectory of the movable end portion of the skew correction roller is an elliptic trajectory not causing any change in a circumferential length of the film.

According to a second configuration of the invention, in the film driving apparatus described in the first configuration, the movement trajectory of the movable end portion of the skew correction roller is a circular trajectory approximating to the elliptic trajectory.

An image forming apparatus according to a third configuration of the invention includes: a driving roller; a film support roller; a skew correction roller; developing-unit opposed rollers; an endless photosensitive film supported by the driving roller, the film support roller, the skew correction roller and the developing-unit opposed rollers; a charger disposed between the driving roller and the film support roller; an exposure light source disposed in a position opposed to the film support roller; and a developing unit disposed in a position opposed to the developing-unit opposed rollers; wherein the skew correction roller has a structure in which one end thereof is movable with the other end as a fulcrum, and a movement trajectory of the movable end portion of the skew correction roller is an elliptic trajectory not causing any change in a circumferential length of the photosensitive film.

According to a fourth configuration of the invention, in the image forming apparatus described in the third configuration, the movement trajectory of the movable end portion of the skew correction roller is a circular trajectory approximating to the elliptic trajectory.

An image forming apparatus according to a fifth configuration of the invention includes: a driving roller; a film support roller; askew correction roller; developing-unit opposed rollers; an endless photosensitive film supported by the driving roller, the film support roller, the skew correction roller and the developing-unit opposed rollers; a charger disposed between the driving roller and the film support roller; an exposure light source disposed in a position opposed to the film support roller; a developing unit disposed in a position opposed to the developing-unit opposed rollers; a skew correction mechanism portion; a tension applying roller; and a tension applying mechanism portion; wherein: the skew correction roller is disposed on a downstream side of the film support roller in a rotation direction of the photosensitive film, and coupled with the skew correction mechanism portion; and the tension applying roller is disposed on an upstream side of the film support roller in the rotation direction of the photosensitive film, and coupled with the tension applying mechanism portion.

According to a sixth configuration of the invention, in the image forming apparatus described in the fifth configuration, the skew correction roller has a structure in which one end thereof is movable with the other end as a fulcrum, and a movement trajectory of the movable end portion of the skew correction roller is an elliptic trajectory not causing any change in a circumferential length of the photosensitive film.

According to a seventh configuration of the invention, in the image forming apparatus described in the sixth configuration, the movement trajectory of the movable end portion of the skew correction roller is a circular trajectory approximating to the elliptic trajectory.

According to the present invention configured thus, it is possible to provide a film driving apparatus in which no adverse effect (such as printing misalignment) is caused by a change in the circumferential length of a film even if there arises the change in the circumferential length of the film due to environmental fluctuation, and it is possible to provide an image forming apparatus using the same film driving apparatus.

DETAILED DESCRIPTION OF THE INVENTION

Figure 1:
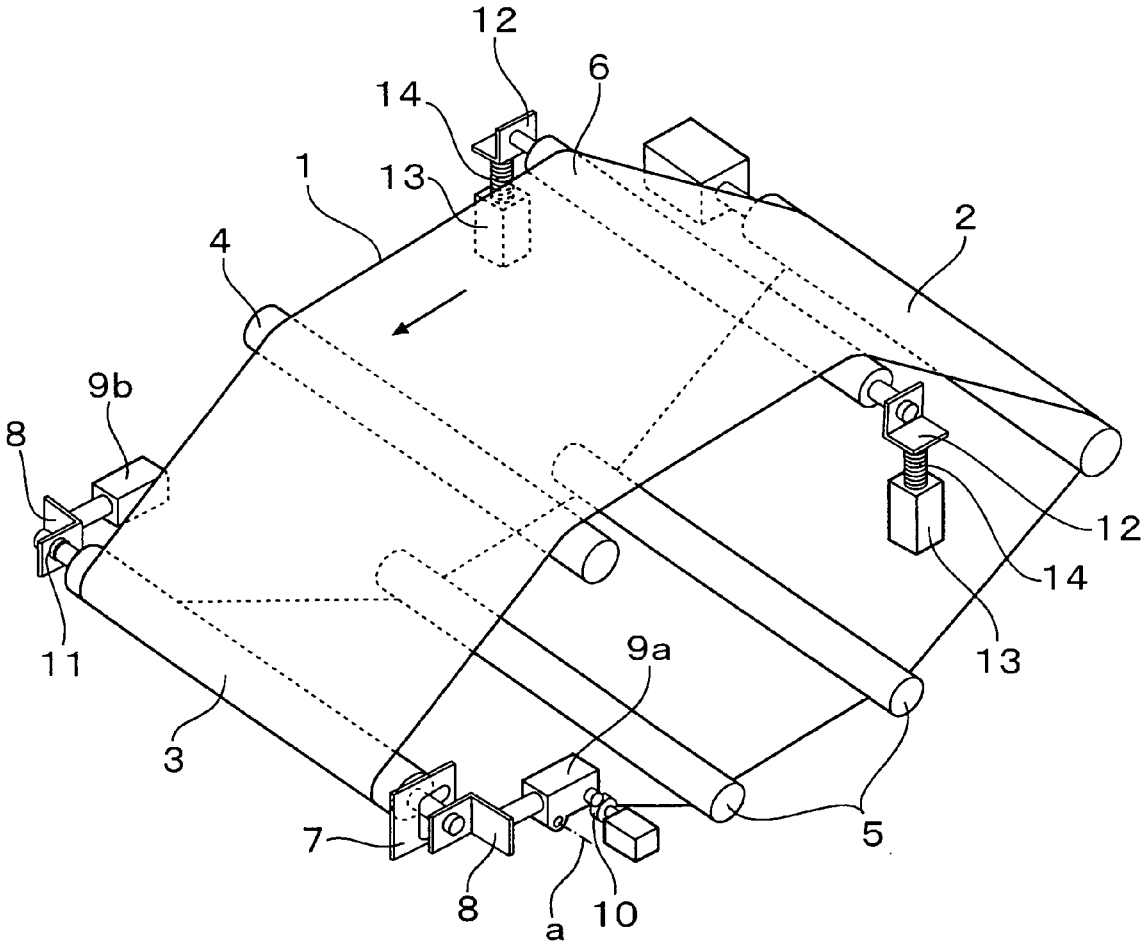
FIG. 1 is a schematic perspective view of a film driving apparatus according to an embodiment of the present invention.
Figure 2:
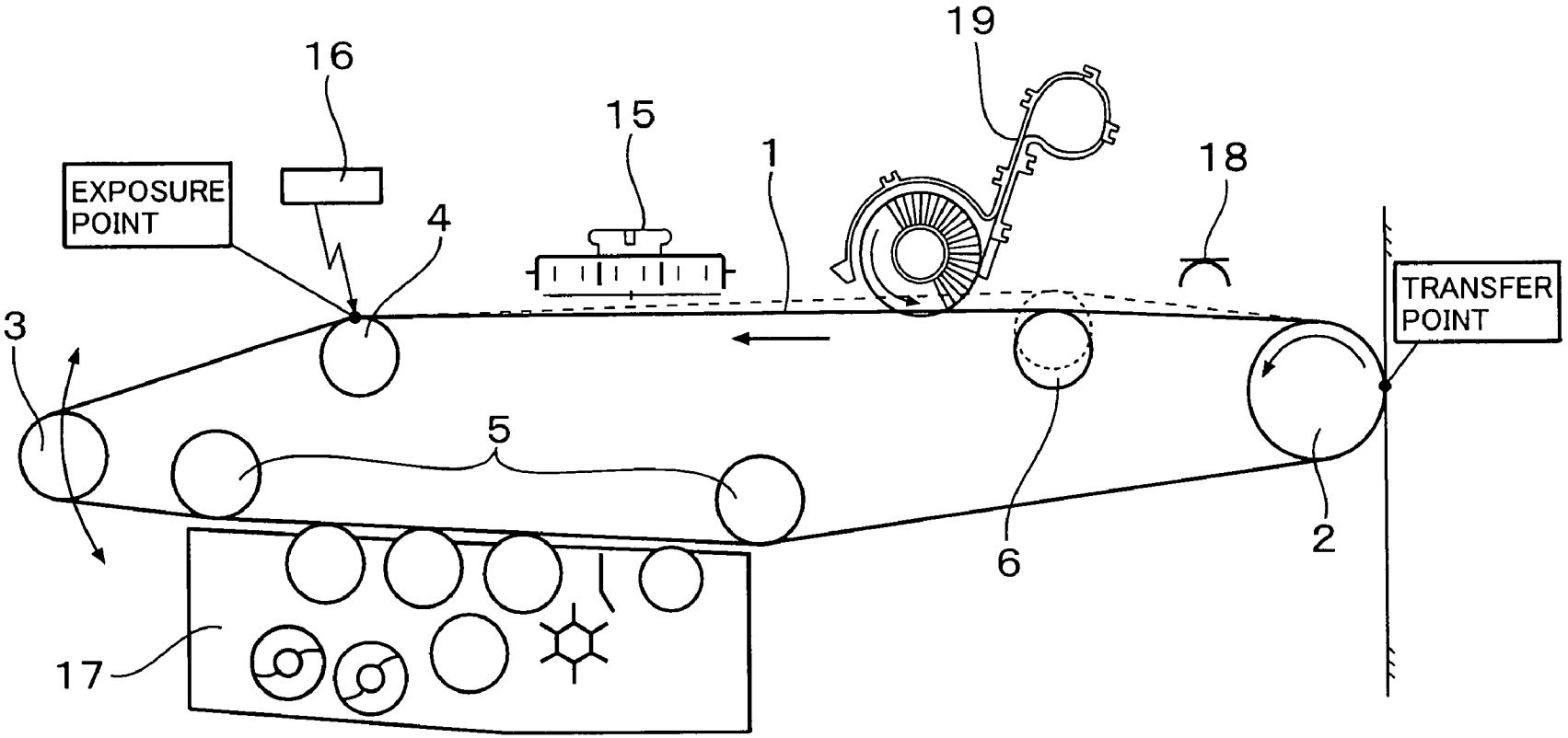
FIG. 2 is a schematic configuration view of an image forming apparatus using the same film driving apparatus.

Next, an embodiment of the present invention will be described with reference to the drawings. FIG. 1 is a schematic perspective view of a film driving apparatus according to the embodiment of the present invention. FIG. 2 is a schematic configuration view of an image forming apparatus using the film driving apparatus.

In FIG. 1, the reference numeral 1 represents a film (photosensitive film); 2, a driving roller; 3, a skew correction roller; 4, a film support roller; 5, a developing-unit opposed roller; 6, a tension applying roller; 7, a guide; 8, a skew correction roller arm; 9*a*, a skew correction roller movable bracket; 9*b*, a skew correction roller fixed bracket; 10, a cam; 11, a self-aligning bearing; 12, a tension applying roller arm; 13, a tension applying roller bracket; 14, a spring; and a, a rotation axis of the bracket 9*a*.

As shown in FIG. 1, the driving roller 2, the tension applying roller 6, the film support roller 4, the skew correction roller 3 and the developing-unit opposed rollers 5 are disposed in that order along the rotation direction (arrow direction) of the film (photosensitive film) 1. In other words, the tension applying roller 6 is provided on the upstream side of the film support roller 4 in the rotation direction of the film, while the skew correction roller 3 is provided on the downstream side of the film support roller 4 in the rotation direction of the film.

The endless film (photosensitive film) 1 is laid over these rolls and supported by them so as to form a path. The film 1 is rotated in the illustrated arrow direction by the driving roller 2.

The configuration of a skew correction mechanism portion will be described. The opposite ends of the skew correction roller 3 are retained by the arms 8 and 8 respectively. The arms 8 and 8 are fixed to the brackets 9*a* and 9*b* through shafts or the like, respectively. The brackets 9*a* and 9*b* are linked with a not-shown frame body so as to retain the skew correction roller 3. Thus, the positions of the arms 8 and 8 relative to the brackets 9*a* and 9*b* are fixed respectively.

The movable bracket 9*a* can be rotated around the rotation axis a by the cam 10. In a fixed end portion of the skew correction roller 3, the self-aligning bearing 11 is used in a portion where the arm 8 is connected to the end portion of the skew correction roller 3. Thus, the movable direction of the movable end portion of the skew correction roller 3 is made free.

Further, the movable end portion of the skew correction roller 3 has a movable range limited by the guide 7. The guide 7 is provided with a hole lying on the elliptic trajectory having focuses in the centers of the film support roller 4 and the developing-unit opposed roller 5 both adjacent to the skew correction roller 3, as described above. The movable end portion of the skew correction roller 3 is designed to move along the aforementioned elliptic trajectory (circular trajectory approximating to the elliptic trajectory).

The configuration of a tension applying mechanism portion will be described. The opposite ends of the tension applying roller 6 are retained by the arms 12 respectively. The arms 12 are connected through their shafts to the brackets 13 including bearings, respectively. Due to the coil-like springs 14 set between the arms 12 and the brackets 13 respectively, the arms 12 move to expand and contract axially so as to apply tension to the film 1.

The tension applying mechanism portion is separated from the skew correction mechanism portion. The tension applying roller 6 is disposed between the driving roller 2 and the film support roller 4 in the stage preceding an exposure point, as shown in FIG. 2.

In the image forming apparatus using the film driving apparatus, as shown in FIG. 2, a cleaner 19 and a charger 15 are placed in the outside between the tension applying roller 6 and the film support roller 4, and a light source 16 for exposure is placed in the outside so as to be opposed to the film support roller 4. Thus, the exposure point is arranged in a film path portion wound on the film support roller 4.

A developing unit 17 is placed in the outside so as to be opposed to the developing-unit opposed rollers 5. The film path portion wound on the driving roller 2 serves as a transfer point.

A process for producing an image on the film 1 will be described. As shown in FIG. 2, the film 1 is charged by the charger 15, and irradiated with a laser beam from the light source 16 so that an exposure point where a latent image should be produced on the film 1 is provided in the film path portion wound on the film support roller 4. Thus, a latent image is produced.

Successively, toner is attached to the latent image by the developing unit 17. The produced image is transferred onto paper, a transfer film or the like at the transfer point. After the transfer, charges of the film 1 are removed by a discharger 18, and residual toner on the film 1 is removed by the cleaner 19 in order to prepare next charging.

When there arises a change in the circumferential length of the film 1 in its film path, the position of the tension applying roller 6 changes as shown in FIG. 2. However, the change of the film path appears only in a section between the driving roller 2 and the film support roller 4 (as shown by the broken line in FIG. 2). All the change of the film path length is absorbed in the section between the driving roller 2 and the film support roller 4. As a result, there is no change in film-path/distance between the exposure point and the transfer point. Thus, the image formed in the exposure point can reach the transfer point while its original printing target position is kept.

Further, in the operation for correcting the skew of the film 1, the movable end portion of the skew correction roller 3 moves in a trajectory not causing any change in the film path length in the section between the exposure point and the transfer point. Accordingly, the image formed in the exposure point can reach the transfer point while its original printing target position is kept without being influenced by the motion of the skew correction roller 3.

In the aforementioned manner, it is possible to avoid printing misalignment which is caused by the change in the circumferential length of the film 1 due to environmental fluctuation or the like and which is caused by the operation for correcting the skew of the film 1.

Figure 3:
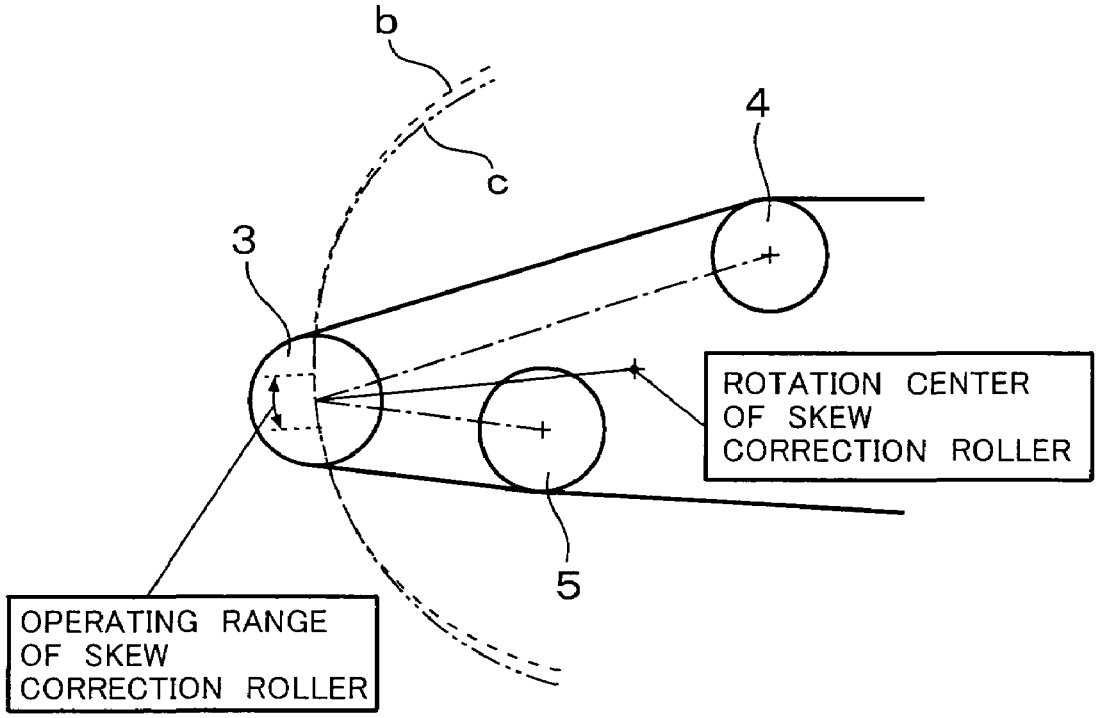
FIG. 3 is a view showing a movement trajectory of a film skew correction roller in the film driving apparatus.
Figure 4:
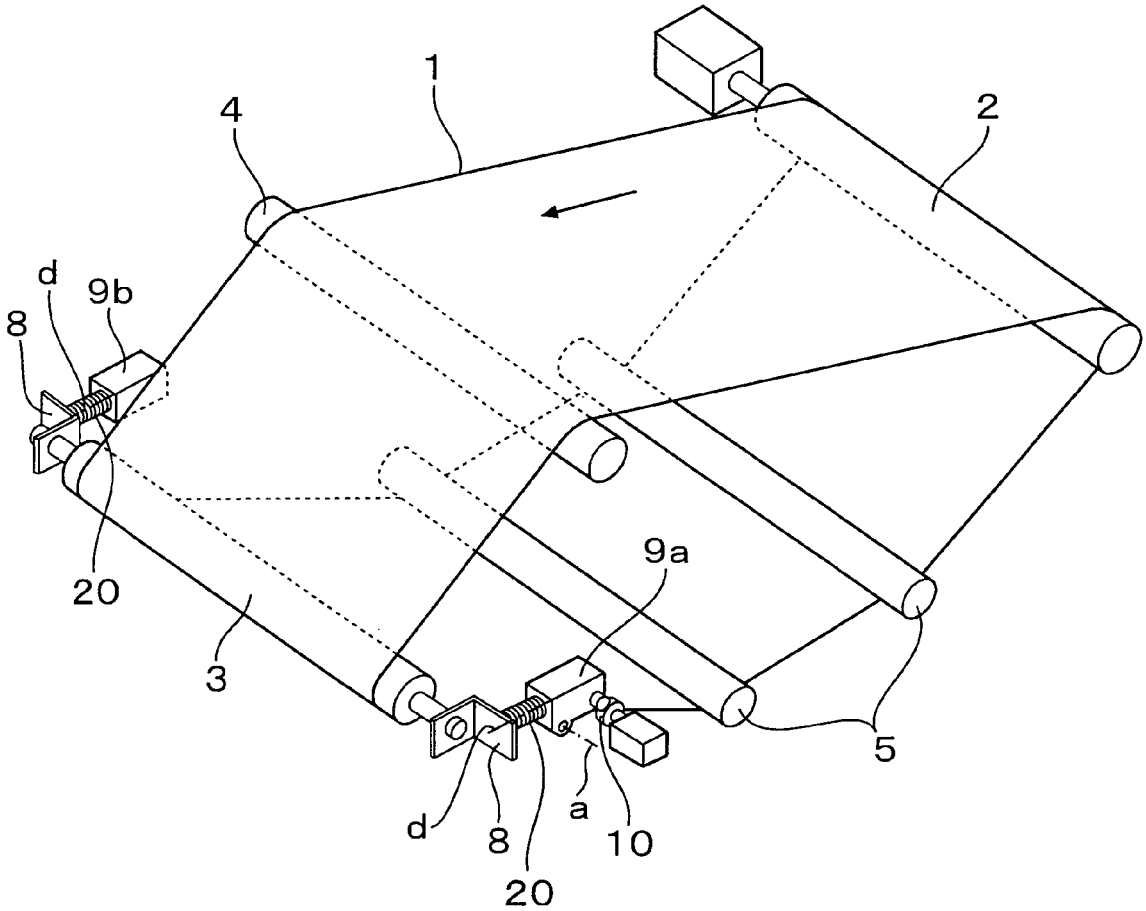
FIG. 4 PRIOR ART
FIG. 4 is a schematic perspective view showing a background-art film driving apparatus;.
Figure 5:
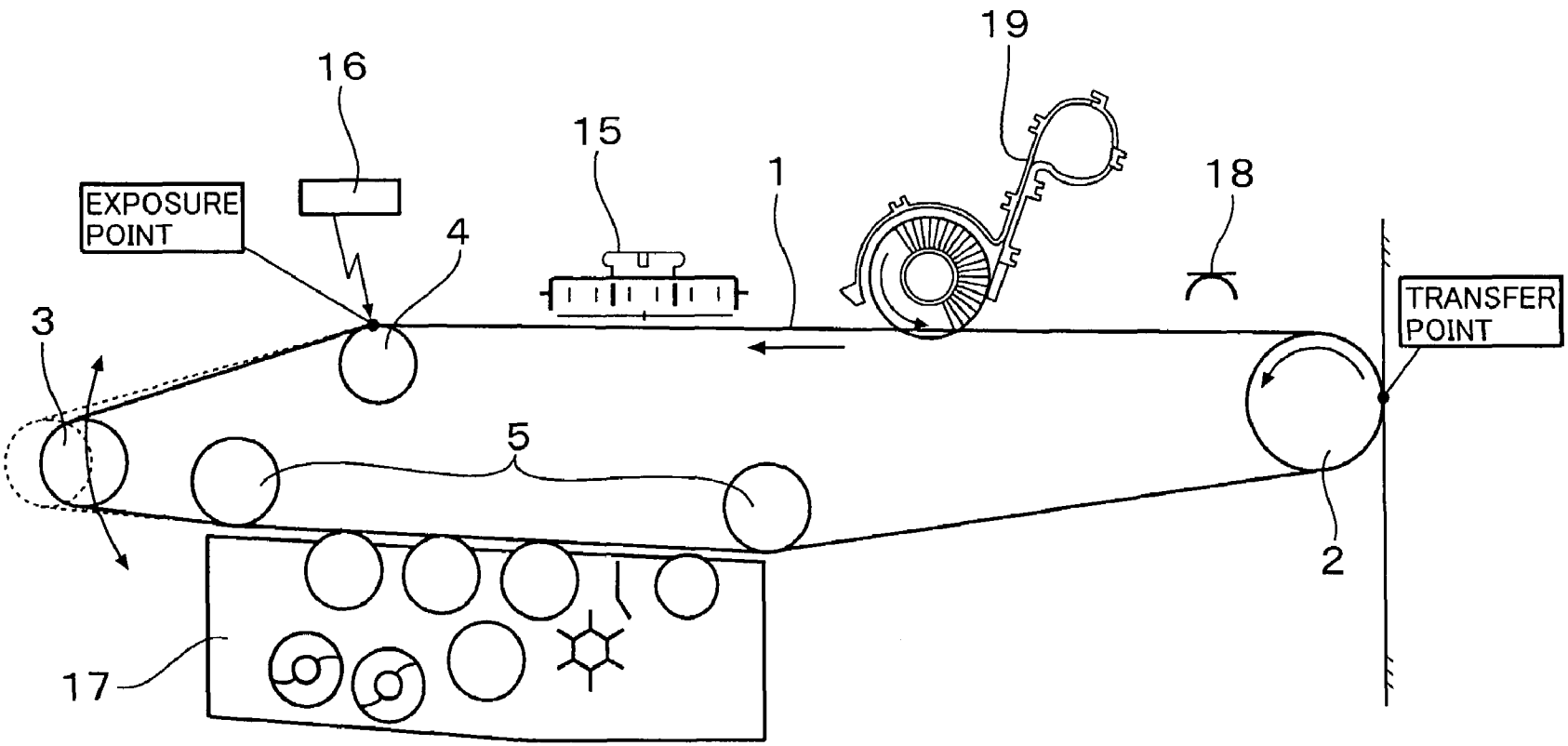
FIG. 5 PRIOR ART
FIG. 5 is a schematic configuration view of an image forming apparatus using the same film driving apparatus.
Figure 6:
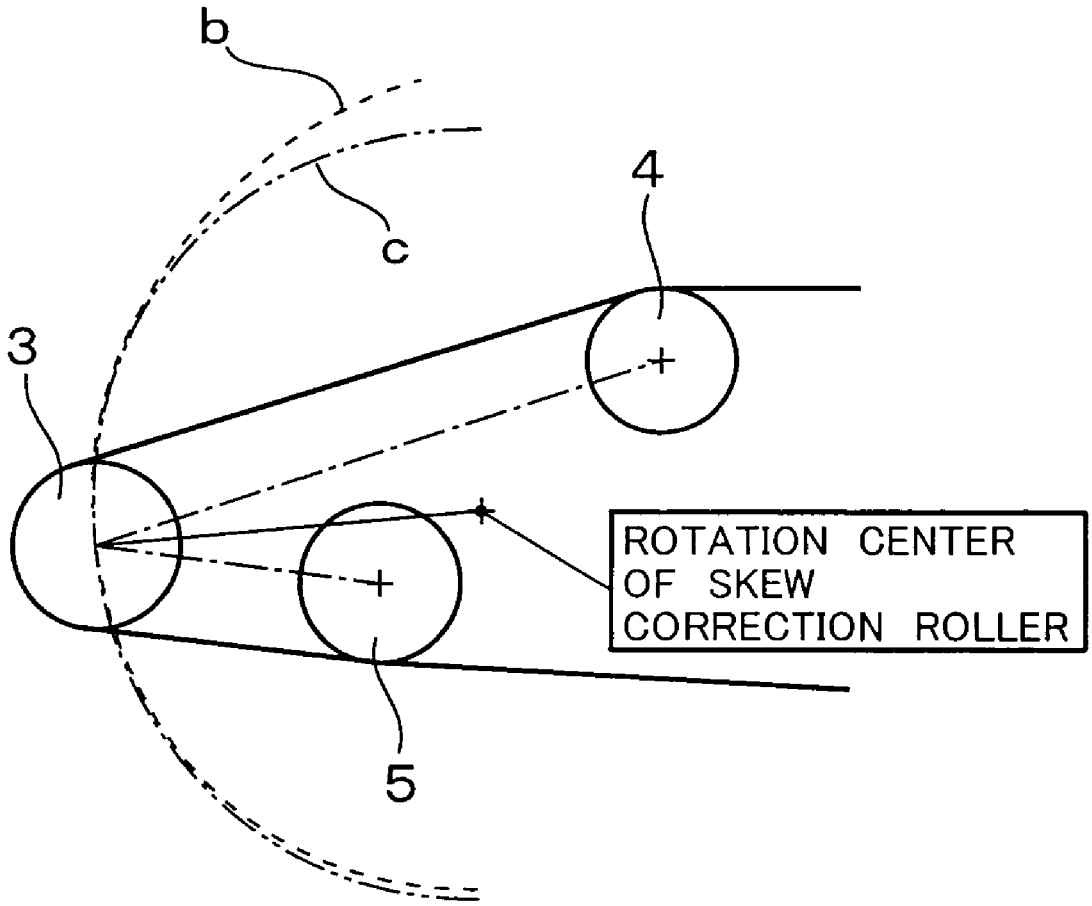
FIG. 6 PRIOR ART
FIG. 6 is a view showing a movement trajectory of a film skew correction roller in the film driving apparatus.

The movable end portion of the skew correction roller 3 may be moved not in the aforementioned elliptic trajectory but in the circular trajectory described above. Even in this case, when the operating range of the skew correction roller 3 is narrowed and the position of the rotation center of the skew correction roller is selected so that a circular trajectory c in the roller movable range approximates to an elliptic trajectory b not causing any change in the film path length as shown in FIG. 3, there is little change in the film path length in the section between the exposure point and the transfer point due to the skew correction operation though the movable end portion is moved in the circular trajectory. It is therefore possible to make the printing misalignment as small as possible.

In the aforementioned embodiment, description has been made about the case of a photosensitive film. The present invention is also applicable to another film such as an intermediate transfer film or a transfer film.

According to the present invention, a tension applying mechanism separated from a skew correction mechanism is provided in a stage preceding an exposure point, while the movement trajectory of a movable end portion of a skew correction roller in the skew correction mechanism is set as an elliptic trajectory not causing any change in the circumferential length of a film. Thus, it is possible to prevent printing misalignment which is caused by the change in the circumferential length of the film due to environmental fluctuation and which is caused by the skew correction operation.

What is claimed is:

1. A film driving apparatus comprising:

a driving roller;

a film support roller; and a skew correction roller; wherein:

an endless film supported by the driving roller, the film support roller and the skew correction roller is rotated in a predetermined direction in accordance with rotation of the driving roller; and the skew correction roller has a structure in which one end thereof is movable with the other end as a fulcrum, and a movement trajectory of the movable end portion of the skew correction roller is an elliptic trajectory not causing any change in a circumferential length of the film.

2. A film driving apparatus according to claim 1, wherein the movement trajectory of the movable end portion of the skew correction roller is a circular trajectory approximating to the elliptic trajectory.

3. An image forming apparatus comprising:

a driving roller;

a film support roller;

a skew correction roller;

developing-unit opposed rollers;

an endless photosensitive film supported by the driving roller, the film support roller, the skew correction roller and the developing-unit opposed rollers;

a charger disposed between the driving roller and the film support roller;

an exposure light source disposed in a position opposed to the film support roller; and a developing unit disposed in a position opposed to the developing-unit opposed rollers; wherein:

the skew correction roller has a structure in which one end thereof is movable with the other end as a fulcrum, and a movement trajectory of the movable end portion of the skew correction roller is an elliptic trajectory not causing any change in a circumferential length of the photosensitive film.

4. An image forming apparatus according to claim 3, wherein the movement trajectory of the movable end portion of the skew correction roller is a circular trajectory approximating to the elliptic trajectory.

5. An image forming apparatus comprising:

a driving roller;

a film support roller;

a skew correction roller;

developing-unit opposed rollers;

an endless photosensitive film supported by the driving roller, the film support roller, the skew correction roller and the developing-unit opposed rollers;

a charger disposed between the driving roller and the film support roller;

an exposure light source disposed in a position opposed to the film support roller;

a developing unit disposed in a position opposed to the developing-unit opposed rollers;

a skew correction mechanism portion;

a tension applying roller; and a tension applying mechanism portion; wherein:

the skew correction roller is disposed on a downstream side of the film support roller in a rotation direction of the photosensitive film, and coupled with the skew correction mechanism portion;

the tension applying roller is disposed on an upstream side of the film support roller in the rotation direction of the photosensitive film, and coupled with the tension applying mechanism portion; and the skew correction roller has a structure in which one end thereof is movable with the other end as a fulcrum, and a movement trajectory of the movable end portion of the skew correction roller is an elliptic trajectory not causing any change in a circumferential length of the photosensitive film.

6. An image forming apparatus according to claim 5, wherein the movement trajectory of the movable end portion of the skew correction roller is a circular trajectory approximating to the elliptic trajectory.

* * * * *